United States Patent [19]

Guth

[11] Patent Number: 4,618,065

[45] Date of Patent: Oct. 21, 1986

[54] SANITARY WASH BOTTLE KIT TWO PART CLOSURE

[76] Inventor: Durward O. Guth, 551 Granville Ave., Hillside, Ill. 60162

[21] Appl. No.: 777,589

[22] Filed: Sep. 19, 1985

[51] Int. Cl.[4] ..... B65D 39/16

[52] U.S. Cl. ..... 215/3; 222/209

[58] Field of Search ..... 222/209; 215/3, 4

[56] References Cited

U.S. PATENT DOCUMENTS

| | | | |
|---|---|---|---|
| 1,328,866 | 1/1920 | Yeatter | 215/3 X |
| 2,687,227 | 8/1954 | Guth | 215/3 |
| 3,578,195 | 5/1971 | Ogle | 215/3 X |
| 4,383,622 | 5/1983 | Guth | 222/209 |

*Primary Examiner*—Donald F. Norton
*Attorney, Agent, or Firm*—A. A. Saffitz

[57] ABSTRACT

A new two part closure for a sanitary wash bottle assembly comprising an inner multiple lobed elastomer plug and a sealing stopper. A dispensing tube passes through the inner plug and a bulb is positioned next to the neck of the flask of the wash bottle. The sealing stopper is formed with a downwardly extending skirt which encompasses the top rim of the wash bottle and an inner lip-matching groove to engage the wash bottle rim at the lip edge. The inner plug member is formed with uniformly spaced apart lobes at the bottom of the plug and with a central axial bore having narrowed portions at the top and bottom of the bore to facilitate pushing in the dispensing tube. The plug is molded by a transfer molding operation and is formed of a yieldable elastomer having a Durometer (Shore A). The multi-lobe construction of the plug provides a yieldable easily manipulated plug mass which can be easily inserted within the outer skirt and cap member of the double stopper assembly. In one preferred embodiment there are five lobes at the base with a 72° separation while in another preferred embodiment there are 6 lobes with a 60° separation.

3 Claims, 8 Drawing Figures

SANITARY WASH BOTTLE KIT TWO PART CLOSURE

FIELD OF THE INVENTION

The invention is in the field of liquid dispensers of the resilient wall type in which the wall is part of a fluid pressure generating pump and is removable from the container as part of a kit or an assembly for the container. The container and bulb are so placed with respect to each other that only one hand is necessary to lift the flask with the container and dispenser, closure and pressure generating bulb in place to permit liquid to be dispensed by squeezing the bulb with the fingers of the same hand and hold the flask. The invention also lies in the field of dispensing and sealing stoppers of multiple part construction in which an outer cap having a dependent skirt is associated with an inner plug through which the bent delivery tube reaching to the bottom of the flask is pushed and positioned.

DESCRIPTION OF THE PRIOR ART

Wash bottles are widely used in chemical laboratories for intermittent delivery of liquids, for example as shown in MacLean, Pat. No. 1,600,189 dated Sept. 14, 1926.

A wash bottle using a bulb of rubbery material as a hand bulb to introduce pressure is described in Severson, U.S. Pat. No. 2,105,957 dated Jan. 18, 1983. Squeeze bulb dispensers have been used such as the pipette shown in Sharples, U.S. Pat. No. 553,044 dated Jan. 14, 1986. Sharples taught in FIG. 2 of his patent the use of an open tube connected to the device which can be covered by a finger and thereby control the flow of liquid being dispensed under air pressure. Also known in the prior art dispensers are automatic burettes fitted with a squeeze bulb as shown in Guyer, U.S. Pat. No. 1,993,001 dated Mar. 5, 1953.

Multiple stopper assemblies are known for use with dispensers such as in Perelsen, U.S. Pat. No. 2,342,215, dated Feb. 22, 1944 and in my own prior patent, Guth, U.S. Pat. No. 4,383,622, granted May 17, 1983.

DIFFERENCES OVER MY PRIOR PAT. NO. 4,383,622

In my aforementioned prior patent, the finger valve providing the air vent in the cap structure was an improvement over the Perelsen Pat. No. 2,342,215 in that the molding of the air duct and air vent was performed within the stopper itself so that the communication of that outside atmosphere with the inside of the flask need not modify the flask structure. However the plug comprising a center portion of my prior two-part stopper shown in my prior Pat. No. 4,383,622 was formed of a rigid composition in precise dimensions and was required to be molded and ground with an abrading wheel in order to get the precise fit required to maintain the air passageway. The cost of manufacture of the rigid center plug is substantially higher than the cost of the present soft elastomer multi-lobed plug. The rigid inner plug of my earlier Pat. No. 4,383,622 was inserted into the interior opening of the cap and skirt by forcing it downwardly to make the entire assembly which is then placed into the opening of the flask. The hardness of the inner plug in my prior wash bottle assembly kit was such as to create resistance within the axial bore for fitting the dispensing tube and certain difficulties were encountered preventing easy insertion of the bent delivery tube. The need for trimming by grinding and abrading operations in order to maintain the air passageway within the flask prompted me to look for more economical and more effective inner plug constructions. The present invention solves this problem of providing a more efficient inner plug of novel multiple lobe construction and design making easier the manipulation of the bent delivery tube and retaining the proper air duct relationship from the outside of the wash bottle to the inside of the wash bottle.

In particular the narrowed portions which are limited in length within the axial bore of the plug to an inner diameter slightly more than the outer diameter of the bent glass tubing, and the fact that the core is made of relatively soft resilient elastomer makes fitting the bent tube much easier.

OBJECTS OF THE INVENTION

An object of the invention is to provide a more efficient and less costly closure for a wash bottle in which a two-part stopper forming a wash bottle kit assembly is arranged to introduce tubing extending to the bottom of the flask and in particular to provide a more efficient inner stopper in the two-part stopper combination which is described and claimed in my prior Pat. No. 4,383,622.

A further object of the invention is to provide an improved inner stopper construction which is formed of a soft elastomer resilient material having multiple lobes equally spaced at the bottom of the inner stopper to provide equal inner engagement at the bottom of the inner stopper against the inner wall of the flask below the lip edge thereof, this engagement serving to anchor and position the entire stopper assembly in the proper closing relationship for the flask so that by using the same hand holding the bottle one can manipulate the bulb of the wash bottle to exert air pressure through the outside of the stopper assembly and against and between the inner interlobal space of the inner stopper.

Further and other objects will become apparent from the drawings herein and the following description of the preferred embodiment and claims.

SUMMARY OF THE INVENTION

The invention relates to an improvement over my prior Pat. No. 4,383,622, granted Apr. 17, 1983 and in particular to a more efficient and less costly closure for a sanitary wash bottle in which a new inner stopper construction is provided having multiple lobes equally spaced at the bottom of the inner stopper for the purpose of providing inner pressing engagement at the bottom of the inner stopper to thereby align the body of the stopper against the inner wall of the flask below the edge of the lip at the top of the flask for the purpose of providing interlobal air spaces which is essential for the free passage of air from within the wash bottle to force the liquid contents out of the interior of the flask. In my prior U.S. Pat. No. 4,383,622, the inner plug member was constructed of a hard and rigid material and no lobar structure was provided. In order to provide the proper fit of the inner stopper in the outer closure which surrounded the outside of the lip and extended with a downwardly projecting skirt portion, it was necessary to grind the top portion of the stopper in order to provide the essential close fit required in producing a planar top edge and at the same time it was necessary to maintain communication about the lower side wall portions of the inner stopper by providing a concave curvature of the side walls which was also ground by precision abrading so that the air communication for pressurizing the liquid contents could be maintained. By pressing the bulb and closing the air vent or finger valve in the side air duct construction of my prior patent, air pressure is introduced into the interior of the flask due to the passage of air from the bulb through the duct along the side portion below the lip within the outer stopper part or cap part and the air is then passed through the bridging horizontal passageway located within the cap assembly above the lip along the concavely tapered side wall portions of the inner plug into the flask. Difficulty with the inner stopper construction, above referred to as the inner plug, was due to the stiffness of this inner stopper which made it difficult to manipulate the bent delivery tube through the central bore of the inner plug. The central bore of the inner plug was molded in a predetermined diameter to assure the proper clearance with adequate sealing for the bent glass tube. There were some instances where carelessness by the user prevented proper sealing of the cap and other instances in which the bent delivery tube was broken.

To overcome the problem of broken tubes and careless assembly, a more efficient inner stopper construction was constructed by transfer molding in which multiple lobes were provided at uniformly spaced intervals along the bottom of the stopper and were shaped to project downwardly at an angle of between 25° and 30° specifically and most preferably between 27° and 28°. By having at least five lobes and not more than six lobes, a separation of 72° or 60° respectively, was achieved. The sealing placement of the delivery tube in the center of the two stopper assembly was assured because only the top and bottom portions of the bore were indented to make the tube easier to penetrate. Also the bottom lobes touched the inside wall at a uniform depth from the top width. The interlobal distances provide an adequate air circulation for ready pressurization of the interior liquid in the flask. The soft and resilient characteristics of the inner stopper are such that the inner stopper is easily manipulated by the fingers and in no instance is it necessary to adjust the vertical position of the body of the inner stopper to either one side or the other side in order to maintain the proper axial alignment of the tube which serves to deliver the liquid contents in its placement in the axial bore of the inner stopper. Equally important is the additional structure which in the axial bore of the inner stopper itself, namely: an indentation at the top portion within the flange and shoulder area of the stopper and at the bottom portion adjacent the downwardly projecting lobes which decrease the diameter of the bore so that the bent glass tube can be readily moved back and forth to each side while the tube is being pushed through the bore in order that the end of the tube reach the bottom of the flask. These three structural modifications involving the change in resilience and softness of the body of the elastomer material, the change in the dimensions of the inner axial bore of the inner stopper and the provision of the downwardly projecting lobes eliminate all of the consumer resistance which was encountered with the improved wash bottle assembly of my prior Pat. No. 4,383,622 granted May 17, 1983.

DESCRIPTION OF THE PREFERRED EMBODIMENTS

Figure 1:
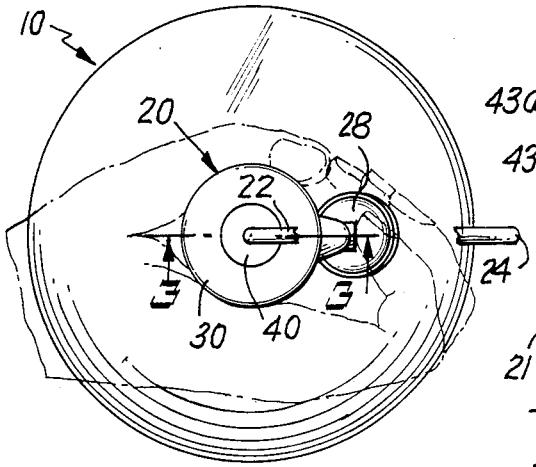
FIG. 1 is a plan view of a wash bottle with a two part stopper according to the present invention and the hand is shown in phantom line to illustrate the utility of the invention.
Figure 3:
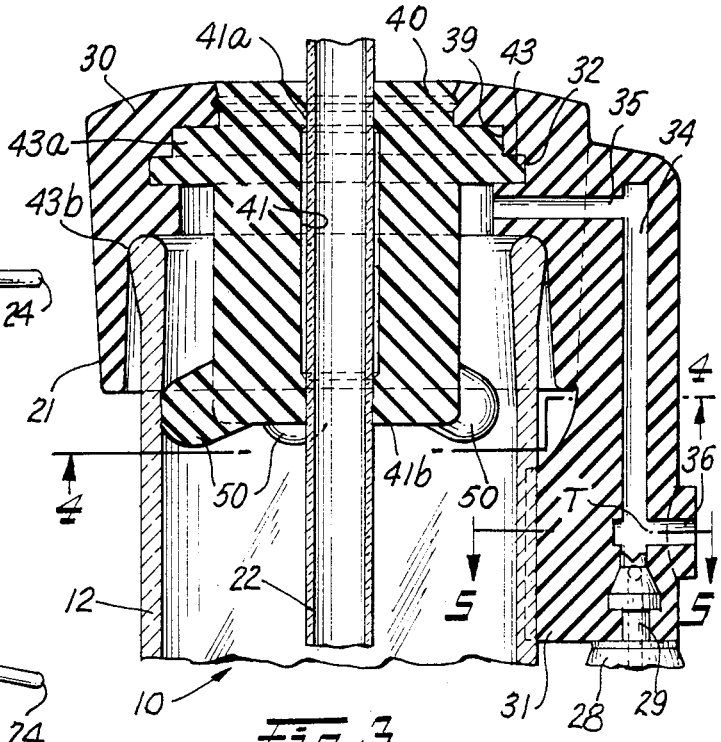
FIG. 3 is an enlarged fragmentary vertical sectional view taken along line 3—3 of FIG. 1 showing the interfitting of the novel inner stopper, the delivery tube and the inner top wall of the wash bottle, the inner stopper having five lobes at the bottom thereof.
Figure 2:
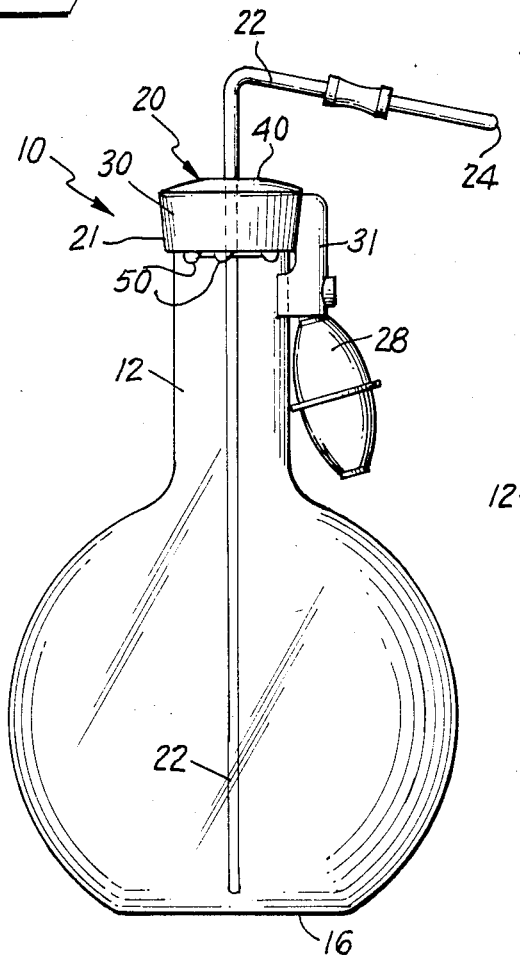
FIG. 2 is an elevational view of the wash bottle of FIG. 1.

As shown in FIGS. 1, 2 and 3, which illustrate the preferred embodiment of a wash bottle 10 assembled with a two part stopper 20 comprising an outer closure 30 which covers the outer lip of the flask 10 and extends therebelow at the skirt 21 together with an inner stopper 40 fitting within the counterbore 39 of the outer stopper 30. The construction of the outer stopper 30 as seen in FIG. 3, provides a critical passageway for pressurized air from the bulb 28. The depending leg portion 31 of the outer stopper 30 is located below the top surface of the two piece stopper 20. This top surface of the two piece stopper positions the inner stopper 40 and outer stopper 30 at the top surfaces to lie along a common plane because of the formation of the inner stopper 40 with a flange 43 precisely dimensioned to snap-fit within a counterbore 39 of the outer stopper 30 and the adjacent inner groove 32 located below the counterbore.

The specific details of the projecting flange 43 are significantly different in the present inner stopper construction 40 in that there is provided an additional projecting shelf **43*a* portion which fits within the double groove represented by the counterbore adjacent groove designated by reference numerals 39 and 32 which are provided within the downwardly projecting skirt portion 21 of the double cap assembly 20**.

A bridging passageway permitting air communication for pressurized air within the pneumatic support comprising the bulb 28, vertical passageway 34 and upper horizontal passageway 35 constituting this bridge, provides for the passage of pressurized air into the interior of the flask 10. The construction of the inverted U-shaped passageway consisting of vertical passageway 34, upper horizontal passageway 35 and the T-structure at the very bottom portion of the depending leg is formed to have an opening in the T structure, opening 36 which is a port covered by the finger at the time that the bulb 28 is squeezed. This port is commonly described as a finger valve. The continuation of the vertical passage 34 fitted to the connector 29 which connects the bulb to the depending leg 31 is the same in the present application as in my earlier Pat. No. 4,383,622 dated May 17, 1982.

The advantages of this molded portion identified as the depending leg portion 31 with bulb assembly and finger port is a very low cost and highly efficient pump mechanism for the wash bottle. The change over my prior patent is specifically directed to the construction of the inner stopper having the multiple downwardly projecting lobes integrally formed with the molded body of the inner stopper 40. As seen in the enlarged sectional view presenting 5 lobes 50 at the bottom illustrated in FIG. 3, there is provided, because of the inherently soft and yieldable characteristic of the elastomer material making up the inner stopper 40, five areas of contact between a portion of these lobes at the outer arcuate surface thereof which press against the inner wall or neck 12 of the wash bottle 10. By pressing down on the inner stopper 40 one readily positions the bottom of the inner stopper in a relationship to the body portion 55 of the stopper such that the stopper is properly positioned within the widest flange 43*b* engaging the corresponding groove of the outer stopper 30. The assembly of the inner stopper 40 in the counterbore 39 of the outer stopper 30 and the simple visual inspection of the lobar positions against the neck 12 of the wash bottle 10 quickly establish that a proper fit has been achieved and the next step for the customer who is assembling the wash bottle assembly is to insert the bent glass tube 22 into the wash bottle through the axial bore 41. The axial bore 41 is indented at the top 41*a* and at the bottom 41*b* to provide a diameter which is substantially the same as the outer diameter of the glass tubing. In the widened diameter zone of the bore 41 which represents about 60 to 80% of the entire vertical extent of the bore, the diameter is significantly greater than at the top and bottom 41*a* and 41*b*, respectively. This narrowing at the top and bottom and widening in substantially the entire extent of the bore provide easier manipulation and penetration of the bent glass tube into the wash bottle so that the bottom of the tubing can be in the proper position in respect to the flat bottom 16 of the wash bottle 10. This proper positioning or spacing is shown in FIG. 2 and assures that pressurization by bulb 28 will force a very small volume of liquid at the bottom of the flask up the tube 22 and out of the outlet 24.

Figure 4:
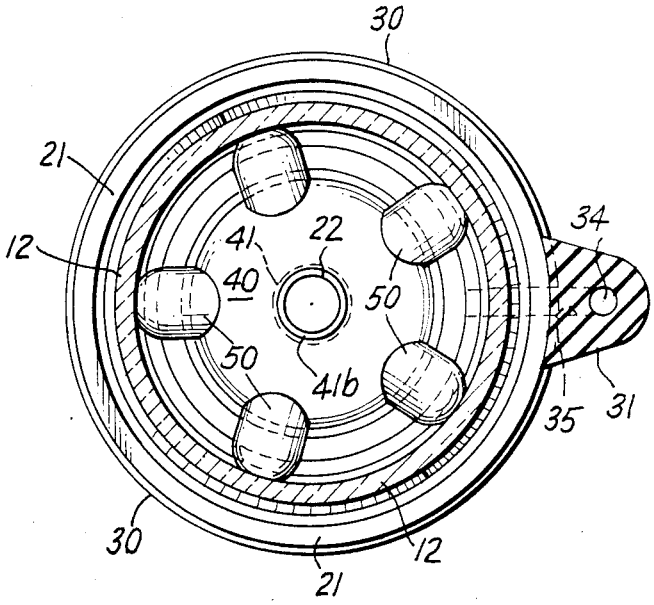
FIG. 4 is an enlarged fragmentary horizontal sectional view along line 4—4 of FIG. 3 showing the interlobar spacing between the neck of the wash bottle and inner stopper for the embodiment of FIGS. 2 and 3.
Figure 5:
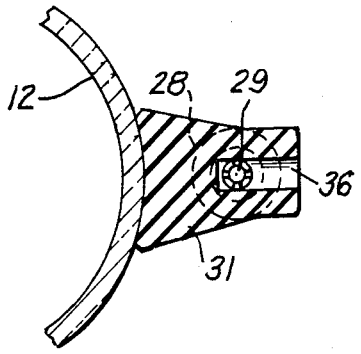
FIG. 5 is a fragmentary horizontal sectional view, taken on the line 5—5 of FIG. 3.
Figure 6:
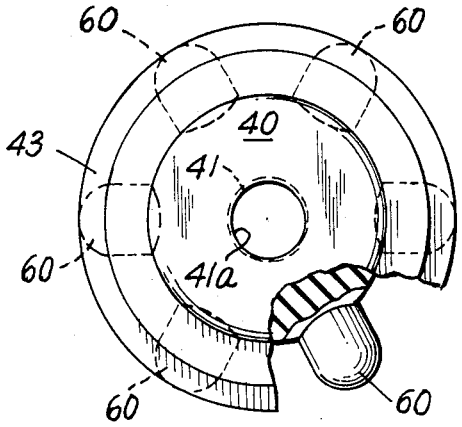
FIG. 6 is a fragmentary plan view of a modification of the inner stopper having six lobes, with a portion broken away for clarity.
Figure 7:
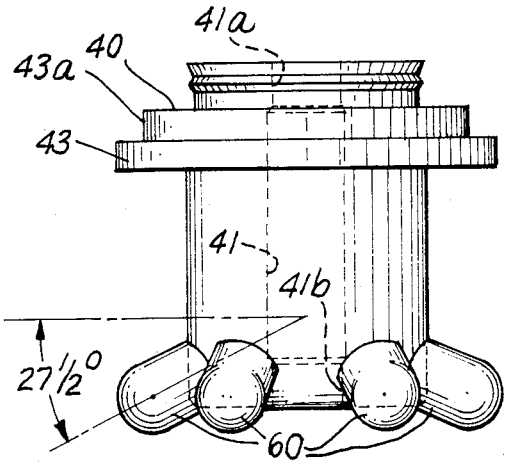
FIG. 7 is an elevation view of the stopper of FIG. 6.

In FIG. 7 there is shown an enlarged elevational view of a modification of the inner stopper 40 having 6 lobes 60 at the bottom, each of these lobes projecting downwardly as was the case with the 5 lobes shown in FIG. 4.

In both embodiments, the 5 lobe embodiment of FIG. 4 and the 6 lobe embodiment of FIG. 7, the axis of the projecting lobes, e.g. the center line of the lobes interacting with a horizontal line perpendicular to the axis of the bore 41 of the inner stopper 40 is shown in both FIGS. 3 and 7 as being at an angle of 27½°. It is within the scope of the invention to have the angle adjustable between 25° and 30°. This downward projection is maintained for both embodiments of FIG. 3 and FIG. 7.

Figure 8:
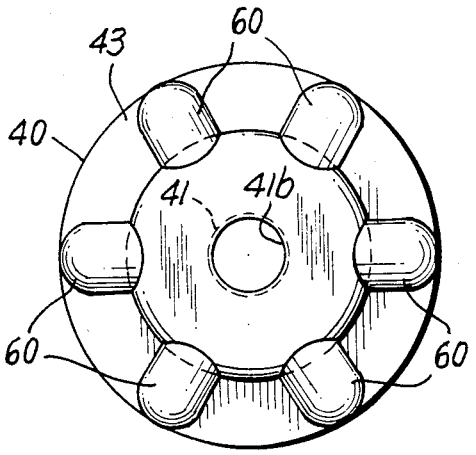
FIG. 8 is a bottom view of the stopper of FIG. 6.

It is a characteristic which is critical of these lobar bottom constructions of the inner stopper 40 that the interlobal distances assure open passageways between the stopper 40 and the inner wall 12 of the flask 10. The 5 lobe design of FIG. 4 provides the separation between the lobes 50 of 72°. The 6 lobe construction of FIG. 8 provides a separation of 60°.

What is claimed is:

1. In a two-part stopper forming a wash bottle kit assembly adapted to introduce tubing extending to the bottom of the flask in which a pressurized liquid passes up the tubing within the flask and out of the outlet to the stopper outside of the flask;

an apertured outer stopper fitted with a counterbore, an inner groove for the lip of the flaks and with a depending leg lying below the top of the stopper and along the neck of the flask contoured to fit against the neck below the lip of the flask, the depending leg having a vertical passageway connected at one end to a pump and at the other end of the leg to a horizontal passageway into the flask;

and an inner stopper formed with a projecting flange fitting within the conterbore of the outer stopper and forming a common top surface, said inner stopper further having a central axial bore for receiving bent tubing extending through to the bottom of the flask to dispense liquid, that improvement comprising:

said inner stopper formed of a soft resilient elastomer material in which the top portion of the inner stopper is formed with a stepped outer flange extending into a recessed portion of the counterbore of the apertured outer stopper;

said inner stopper being further formed at its bottom portion with downwardly projecting lobes equally spaced around the circular cross-section to provide at least five and not more than six soft yieldable compressible contact surfaces against the inner side walls of the flask and below the lip thereof;

said multiple lobes providing interlobar spaces for the free passage of pressurized air from the bulb through the dependent leg across the horizontal passageway and in the space between the inner stopper and the outer stopper and said inner stopper being provided with an axial bore having a diameter at the top and bottom of said stopper which is slightly larger than the diameter of the bent tubing introduced through said bore, said axial bore being widened below the top portion and above the bottom portion to be slightly wider in this middle portion thereby facilitating manipulation of the glass tubing while it is being pushed through the bore.

2. A two-part stopper as claimed in claim 1 wherein said inner stopper is provided with six lobes projecting downwardly from the horizontal at an angle of approximately 27°–28° and wherein said lobes are separated by an angle of 60° to provide six lobes at the base of said stopper.

3. A two-part stopper as claimed in claim 1 wherein said lobes project downwardly from the base of said stopper at an angle between 27° and 28° and there is a separation of 72° between said lobes to provide five lobes at the base of said inner stopper.

* * * * *